US010906719B2

(12) United States Patent
Pincus

(10) Patent No.: US 10,906,719 B2
(45) Date of Patent: Feb. 2, 2021

(54) MOLDED FIBER CUSHIONING

(71) Applicant: Apple Inc., Cupertino, CA (US)

(72) Inventor: Derek Bowman Pincus, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 49 days.

(21) Appl. No.: 16/265,694

(22) Filed: Feb. 1, 2019

(65) Prior Publication Data

US 2020/0095046 A1 Mar. 26, 2020

Related U.S. Application Data

(60) Provisional application No. 62/735,756, filed on Sep. 24, 2018.

(51) Int. Cl.
*B65D 81/05* (2006.01)

(52) U.S. Cl.
CPC ..... *B65D 81/058* (2013.01); *B65D 2581/053* (2013.01)

(58) Field of Classification Search
CPC ..... B65D 81/058; B65D 2581/053; B65D 81/05; B65D 81/053; B65D 81/107; B65D 81/1075
USPC ..... 206/586, 521, 583
See application file for complete search history.

(56) References Cited

U.S. PATENT DOCUMENTS

| | | | | |
|---|---|---|---|---|
| 6,247,596 | B1 * | 6/2001 | Muyskens | B65D 81/054 206/497 |
| 6,286,683 | B1 * | 9/2001 | Hunt | B65D 81/054 206/320 |
| 6,405,873 | B2 * | 6/2002 | Koike | B65D 81/025 206/320 |
| 6,877,608 | B2 * | 4/2005 | Koike | B65D 81/133 206/523 |
| 7,044,303 | B2 * | 5/2006 | Van Der Werf | B65D 81/133 206/488 |
| 7,131,617 | B2 * | 11/2006 | Bontrager | B65D 81/058 248/345.1 |

* cited by examiner

*Primary Examiner* — King M Chu
(74) *Attorney, Agent, or Firm* — Sterne, Kessler, Goldstein & Fox P.L.L.C.

(57) ABSTRACT

Packaging may include cushioning elements. Molded fiber cushioning elements may be configured as end caps, and may include independently flexible panels. The cushioning elements may include an upper and lower panel fixed together about their periphery, but free to bend and translate about and along each other otherwise. The cushioning elements may include opposed mechanical bends that are proximate a friction interface, thereby allowing the cushioning element to absorb impact and vibration, and replacing the need for less environmentally friendly cushioning, such as expanded polystyrene or foam cushioning.

20 Claims, 7 Drawing Sheets

MOLDED FIBER CUSHIONING

CROSS-REFERENCE TO RELATED APPLICATIONS

This application claims priority to U.S. Provisional Patent Application No. 62/735,756, filed Sep. 24, 2018, titled "Molded Fiber Cushioning," which is incorporated herein in its entirety by reference thereto.

FIELD

The described embodiments relate generally to packaging. More particularly, the present embodiments relate to packaging using opposing pivot points such that a cushioning effect is produced during an impact.

SUMMARY

Product packaging is an integral part of a customer's experience. It introduces the customer to their product, and can affect the customer's feelings toward the product and the company that created it. Even intermediate packaging, such as components that are designed to provide cushioning in transit and not package the finished good, may impart a brand image to the ultimate product. This is especially true for companies that wish to move toward a single stream recycling solution for their packaging. In general, current high performing cushioning structures usually are made of plastic materials such as expanded polystyrene. And retention films used are similarly constructed from non-environmentally friendly materials. While these materials provide adequate cushioning, they are not environmentally friendly and use nonrenewable resources for their raw material.

In contrast, some more environmentally friendly materials such as molded fiber structures may be prone to permanent deformation. While these materials may absorb the energy of a single impact, past components risk losing their dimensions, absorption and retention properties, etc. after a single or very few impacts. If a company wishes to use materials such as molded fiber in these types of applications, a past solution would be simply to add additional layers, complex substructures, etc. that add both weight and cost. This weight and cost still may not realize the benefit of elastic properties, e.g., when used to support certain products or finished goods boxes. And in the case of finished goods boxes that also use environmentally friendly materials (e.g., cellulose based materials), additional cushioning is further desirable to enhance the robustness in terms of impact and vibration protection.

What is needed is a new molded fiber structuring paradigm that can absorb repetitive impacts while maintaining shape through design innovations that give the finished components elastic properties similar to expanded polystyrene, foams, etc.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
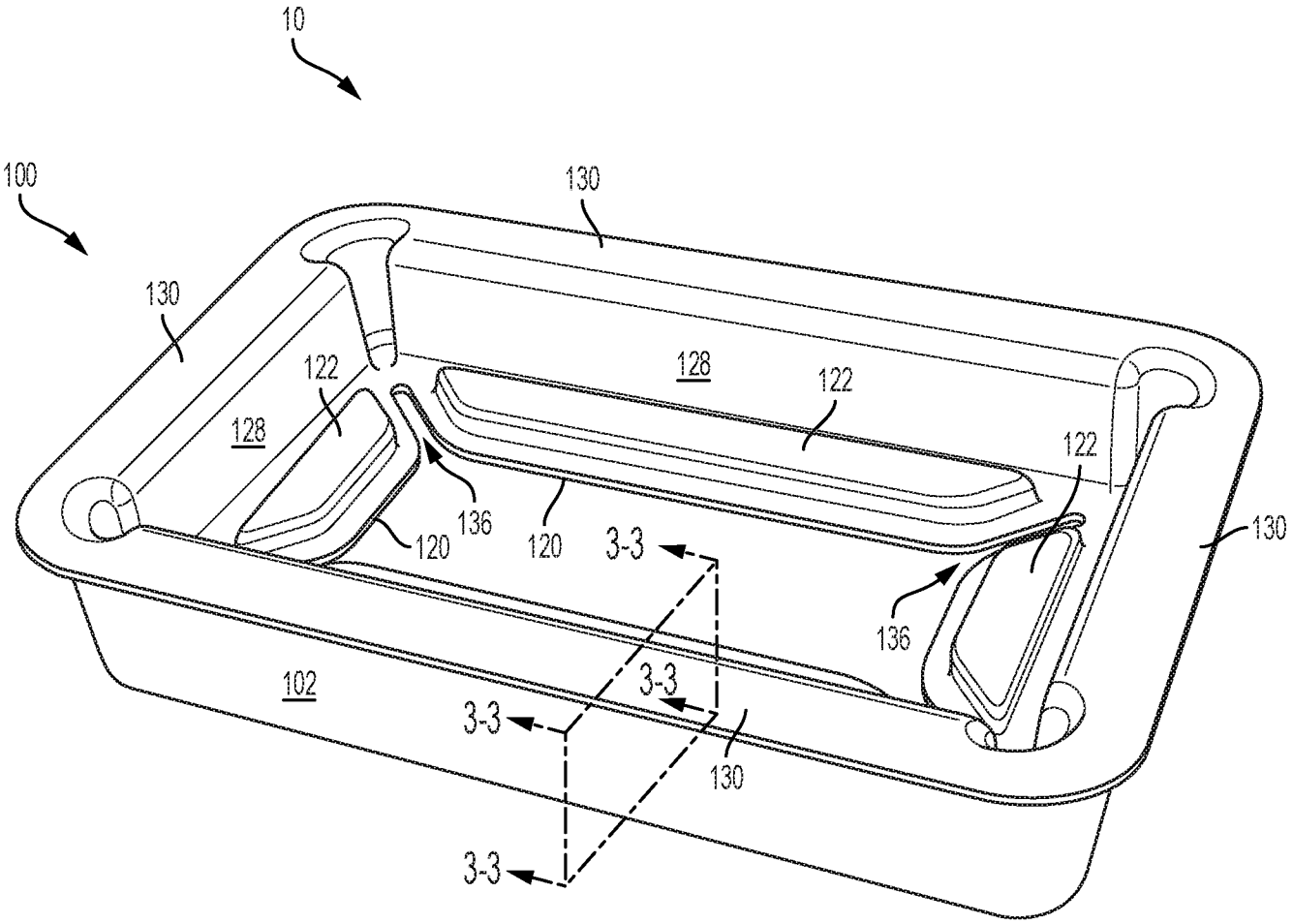
FIG. 1 shows a top isometric view of a packaging component in an embodiment.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

As described above, the packaging described herein provides a cushioning solution utilizing environmentally friendly materials, such as molded fiber (or other cellulose-based material). Cushioning elements are described that achieve cushioning properties from forced friction interaction between two opposing pivot points that are allowed to flex due to offset load designs, and interaction between component features. In general, the opposing pivot points direct and focus impact energy outward, downward, or both, thereby increasing the time of product deceleration during an impact. In some embodiments, the cushioning element is configured such that its side walls bow or flex inward, toward the product, and further limit movement when the product would otherwise be subject to vibration or other movement.

Some embodiments include packaging including a cushioning element comprising molded fiber. The cushioning element includes a pair of opposing flexure points that are configured such that an impact is absorbed. The cushioning element may be formed from a top component and a bottom component (e.g., top and bottom molded fiber panels) that are adhered together near respective peripheries to fix them together in a spatial relationship. The remainder of the components may be free of adhesion, except for a controlled friction interface at the opposing flexure points. The flexure points may engage one another through a friction interface, such that the bending flexure of the respective components is controlled through a predetermined distance of travel that is controlled by the friction between the top panel and the bottom panel of the cushioning element. The opposing flexure points are allowed to flex due to offset load absorption and the forced friction interaction between the two opposing pivot points.

The top and bottom panels of the cushioning element may be contoured such a a single panel may bend or contour to provide a product support surface, sidewalls, flanges, etc., similar to a deep drawn sheet metal or thermoplastic part. In some embodiments, the top and bottom panel of the cushioning element may be a continuous sheet. The bending or flexure of the top panel and bottom panel during an impact may further cause a sidewall of the cushioning element to flex or bow inward, thereby effectively squeezing a product therein. The respective components may be formed of the same material or different materials (e.g., different cellulose-based material). For example, the top panel may be made from molded fiber, and the bottom panel may be made from greyboard. The cushioning element may be configured as an end cap.

A finished package may include other components such as a lower box or tray, a lid, or additional end cap/cushioning elements. The lower box may wholly envelop the bottom surface of the cushioning element such that it is not visible to a customer. The cushioning element may hold or support a finished product, a finished good box, or the like.

Advantageously, this improves upon prior systems having, for example, expanded polystyrene components, that are less environmentally friendly than molded fiber components. By designing appropriate cushioning elements using molded fiber by taking advantage of opposed flexure points and forced friction interaction between two molded fiber panels, impact resistance and elasticity can be achieved through molded fiber components.

Advantageously, components described herein may provide a completely fiber based alternative to traditional expanded polystyrene, foam, or flexible retention film shipper designs used in previous packaging. Through these designs, smaller footprints are achievable thereby increasing shipment efficiency. Further, the smaller footprints also reduce shipping costs, e.g., relatively expensive air freight costs.

Companies may be sensitive to the cost of packaging and may wish to promote packaging that is eco-friendly. Certain packaging materials are higher cost due to their processing, and while engineers may be able to design single-component packaging, the cost may be prohibitive for certain materials. Optimization of packaging in material usage may help keep costs low, and if done well may not interfere with, and may promote, a positive user experience. Packaging made out of recyclable and/or biodegradable materials, such as paper or other cellulose-based products can reduce environmental impact. Packaging that is interesting in character and well-executed may boost a product's or a brand's reputation, thereby attracting new customers and retaining previous customers.

In utilizing eco-friendly materials such as molded fiber structures, prior designs may be more prone to permanent deformation during shipping. As described above, while these materials may absorb the energy of a single impact, past components risk losing their dimensions, absorption and retention properties, etc. after a single or very few impacts. Packaging described herein improves on past designs, and provides eco-friendly components that may absorb multiple impacts due to their resilient design, and protect against potentially harmful vibrations during shipping without adding additional components, complex substructures, etc.

Packaging described in this document achieves these and other beneficial characteristics by balancing structural robustness, eco-friendly materials, and aesthetic elements.

To keep the product protected and secure during transport, handling, or storage, the molded-fiber cushioning element may include molded recesses or features to hold various components, documents, and products. A lid or other cushioning element for example may cover the product and the molded-fiber cushioning element when the packaging is closed. A product contained by the packaging may be, for example, an electronic device such as, for example, a laptop, tablet computer, or smartphone, or it may be a non-electronic device, such as, for example, a book.

In some embodiments, the packaging may be retail packaging (i.e., finished packaging for containing and conveying a product to a user such as may be used in a retail setting, not shipping packaging for containing a packaged product during shipment) that one may expect to find on the shelf in a retail store, and which one may open after purchase to directly access their product. In that case, one or more end cap type components described herein may be coupled to one another to enclose a product, e.g. with a hinge and closure mechanism for example.

These and other embodiments are discussed below with reference to the accompanying figures. However, those skilled in the art will readily appreciate that the detailed description given herein with respect to these figures is for explanatory purposes only and should not be construed as limiting.

Figure 2:
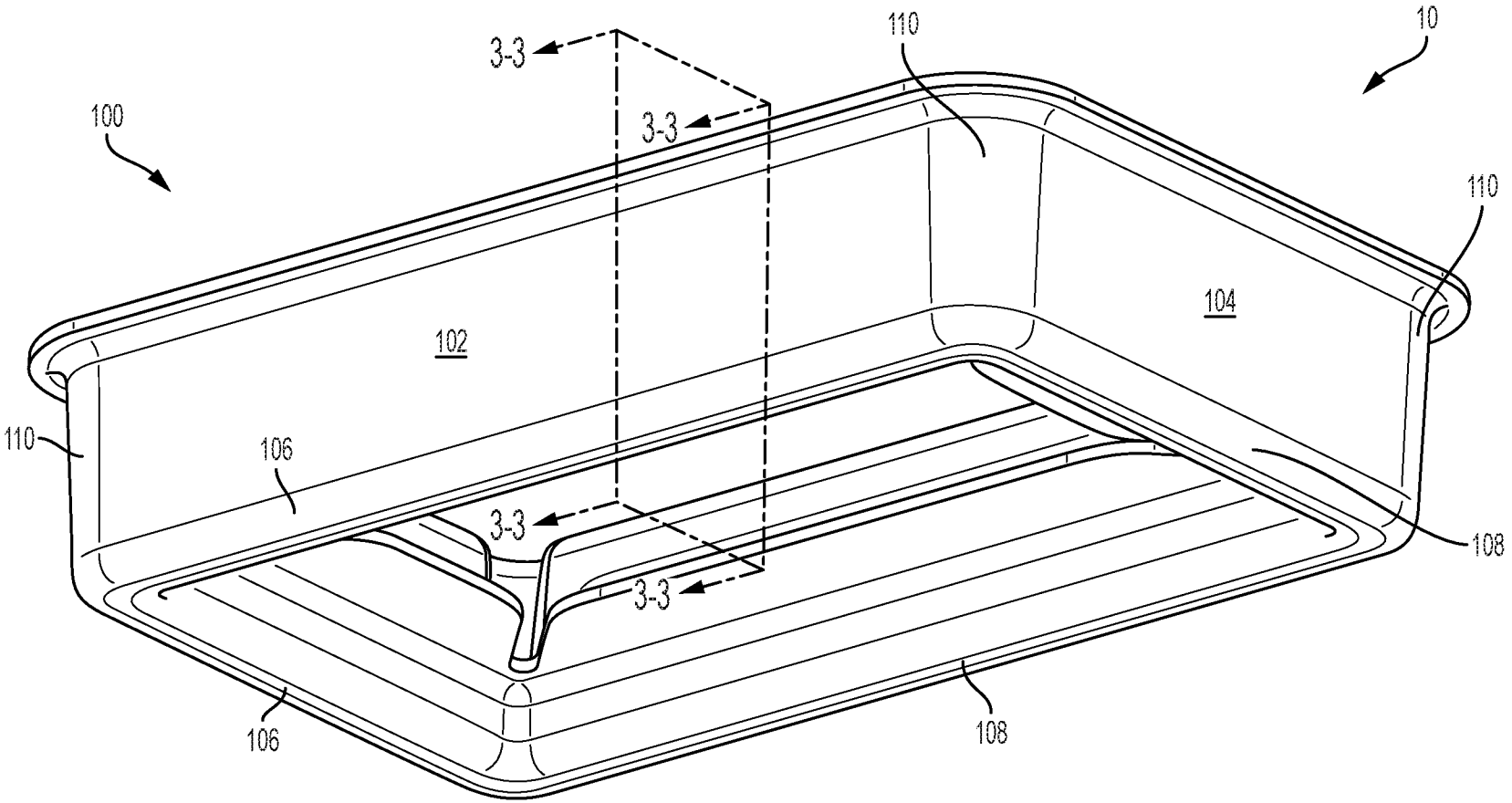
FIG. 2 shows a bottom isometric view of the packaging component shown in FIG. 1.

FIGS. 1 and 2 show a top and bottom isometric view, respectively, of packaging 10 including cushioning element 100 according to some embodiments of this invention. The cushioning element includes sidewalk 102 and 104. Cushioning element 100 similarly includes side corners 110 along with bottom corners 106 and 108. Each of corners 110, 106, and 108 may be rounded from an outward perspective. Cushioning element 100 includes product support surfaces 122. As shown in FIG. 1, product support surfaces 122 may be configured such that they extend inward from an inner wall such as sidewall surface 128 of cushioning element 100. In this way, gaps 136 may isolate product support surfaces 122 from one another. This allows product support surfaces 122 to flex and bend independently from one another. As shown in FIGS. 1-2 for example, cushioning element 100 may include upper peripheral surfaces 130. Packaging 10 may also include, for example, a lid, a tray, support structures, base box, etc. In some embodiments, a first cushioning element 100 may at least partially enclose an upper portion of a product, and a second molded fiber cushion component 100 may at least partially enclose a lower portion of the same product, such that the molded fiber cushion components form end caps for the product (similar to FIG. 7).

Figure 3:
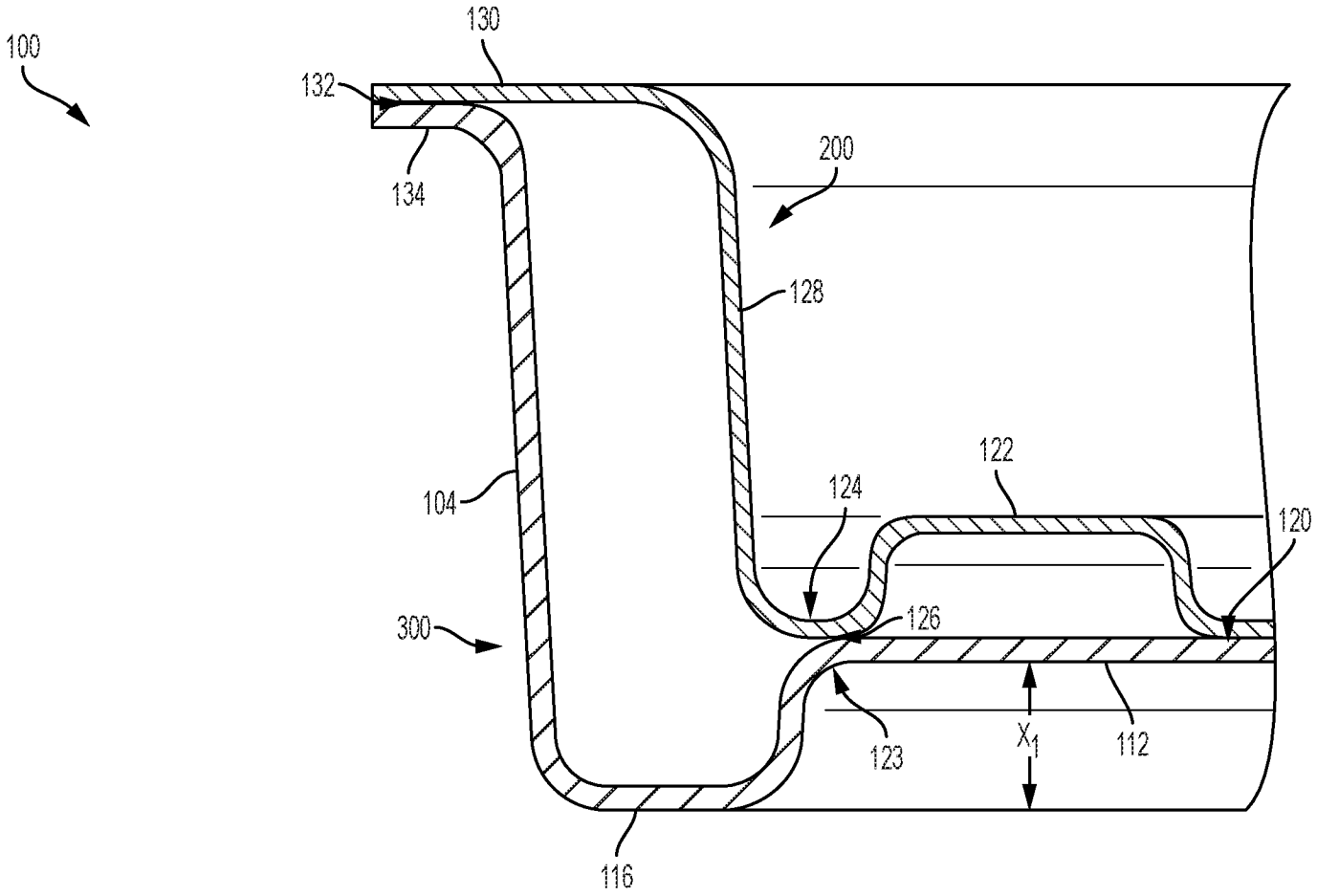
FIG. 3 shows a cross-sectional schematic view of the portion of the packaging along line 3-3.

Turning to FIG. 3, a cross-section schematic is shown of cushioning element 100. As shown, cushioning element 100 may be formed from molded fiber components 200 and 300, each configured as an upper and lower panel, respectively. Molded fiber component 200 is shown adhered to molded fiber component 300 at regions 132 and 120, respectively, which may be peripheral regions of the components. These adhesion regions 132 and 120 fix components 200 and 300 together in a spatial relationship. Adhesion region 132 fixes upper peripheral surface 130 to lower peripheral surface 134 along an outer edge of cushioning element 100. Adhesion region 120 similarly fixes upper peripheral surface 130 to lower peripheral surface 134 along an inner edge of cushioning element 100 (and an inner edge of product support surface 122).

Cushioning element 100 may include lowermost surface 116, for example extending below upper component 200 and formed from lower component 300. Lowermost surface 116 may be configured to rest inside a box, or on top of any other support surface such as another cushioning element 100, product, finished goods box, etc. During manufacturing, the components 200 and 300 may be adhered together at adhesion regions 132 and 120 (e.g., pressed together with pressure sufficient to activate an adhesive within adhesion regions 132 and 120, where the adhesive is a pressure sensitive adhesive). In some embodiments, the peripheries of components 200 and 300 may be cut out after the components 200 and 300 are adhered together. The components 200 and 300 may be formed as a panel, contoured such that sidewalls 128 may form a cavity to receive a product therein. Interior sidewalls 128 may define an interior periphery that transitions into the product support surface 122 and allows the product support surface 112 to flex relative to the adjacent sidewall.

A vertical distance X1 is shown between lowermost surface 116 and panel 112, which is adhered to upper component 200 at adhesion region 120. Panel 112 also interacts at a friction interface 126 between upper component 200 and lower component 300. In some embodiments, there may be no friction interface, and the components may be separated. In some embodiments, there may be a contact interface, without the interface being a friction interface. If a product contained within cushioning element 100 transmits a downward impact force on product support surface 122, e.g., if the packaging is dropped, cushioning element 100 provides elasticity and protection during an impact event, or predetermined force applied to product support surface 122. It is through the forced interaction of frictional contact at friction interface 126 that flex regions or points 124 and 123, respectively flex and bend such that vertical distance X1 decreases. If a product contained within cushioning element 100 transmits a downward impact force on product support surface 122, e.g., if the packaging is dropped, cushioning element 100 provides elasticity and protection during the impact event. The frictional interface may allow for translation of components 200 and 300 such that the impact is absorbed without damage to cushioning element 100.

Figure 4:
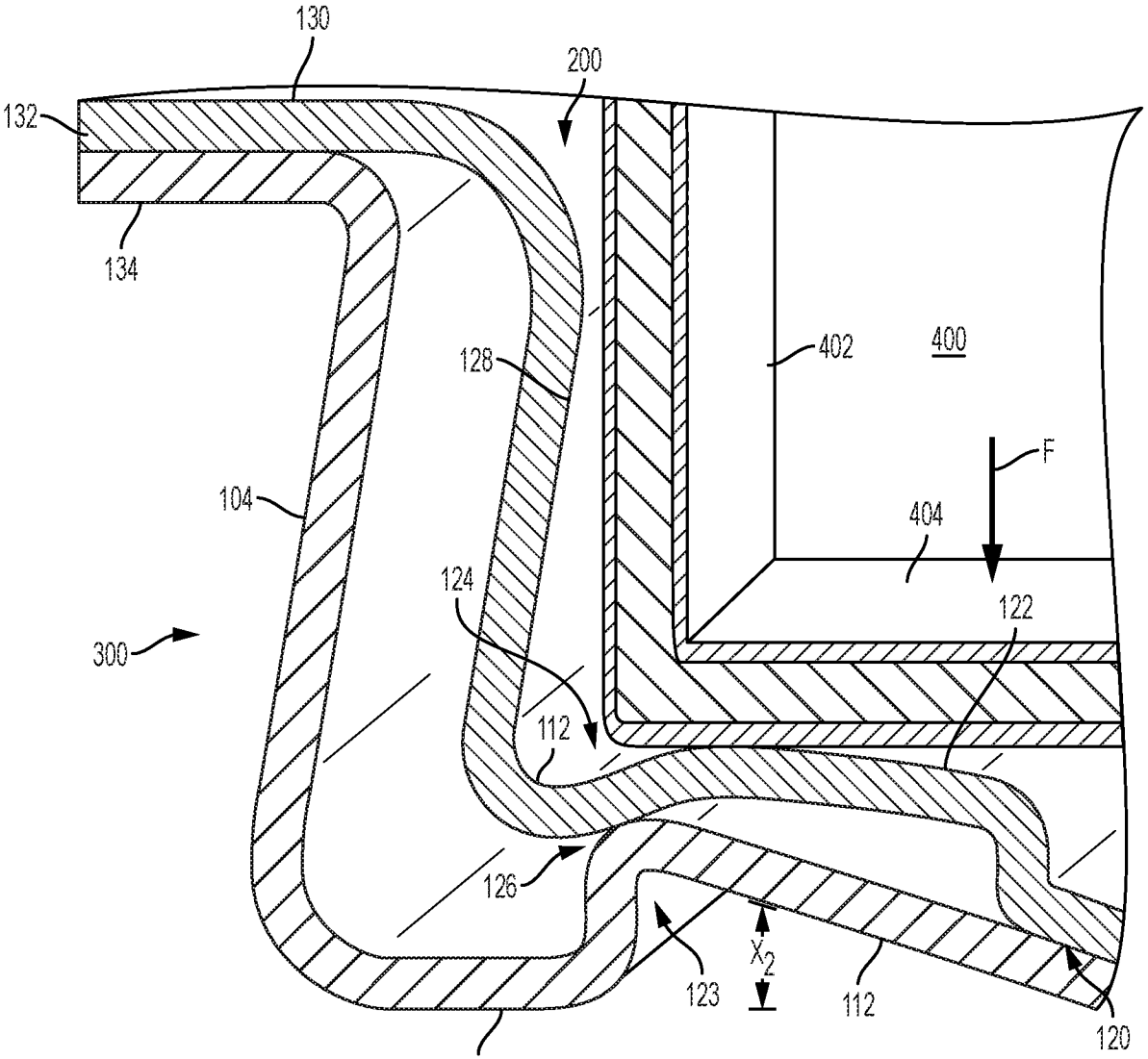
FIG. 4 shows cross-sectional schematic view of the portion of the packaging shown in FIG. 3 in a deformed state and shows a product held by the packaging.

Turning to FIG. 4, an exaggerated cross-section schematic is shown of cushioning element 100 showing a second, flexed configuration and the support of a finished goods package, e.g., box 400. Box 400 may include a lower surface 404 supported by product support surface 122, along with sidewall 402. As shown, cushioning element 100 supports finished good box 400 at product support surface 122. The configuration shown in FIG. 4 shows a flexed configuration, whereby cushioning element 100 is shown to absorb a force shown as a downward arrow annotated as F (for example an impact or vibration) downward from finished goods box 400, such as during a drop event. As shown in FIG. 4, in this configuration vertical distance X2 is less than vertical distance X1 shown in FIG. 3. This is because flex regions 124 and 123 deflect to absorb the impact elastically and return to their original position when the impact is finished (i.e., deflection experienced by cushioning element 100 is less than an amount that would cause permanent deformation). At the same time, friction interface 126 allows surfaces from component 200 and component 300 to translate along one another at friction interface 126, directing energy downward and outward during an impact, for example. In the case of smaller impact events or vibrations, the dimensional variation of the angle of sidewalls 128 may be imperceptible to a customer. Moreover, depending on the overall dimensions of the packaging 10 and materials selected, these interference dimensions may be varied such that for representative impact events such as drops, the product or finished goods box 400 held by the packaging experiences peak acceleration of less than a predetermined threshold.

As shown in FIG. 4 sidewalls 128 and 104 may deflect inward upon impact from a drop event, thereby squeezing box 400 alongside wall 402. In this way added security is provided finished goods box 400 during an impact or vibration. The inner surfaces of sidewalls 128 may cooperate to provide a cavity corresponding to the outer shape of finished goods box 400, or simply a product. In other words, sidewalls 128 may be disposed immediately around the periphery of finished goods box 400 or a product. As shown in FIGS. 1 and 2 for example, the interior of the cushioning element has a generally rectangular shape, though other shapes can also be used for it as well as other packaging components (as in FIGS. 5 and 6, for example).

Cushioning element 100 may be formed of molded fiber (e.g., entirely formed of molded fiber). As described, the opposing flexure points 124 and 123 are configured as opposing flexure points such that an impact may be absorbed, and allow for elasticity in a molded fiber cushioning element, flexing in opposing mechanical directions while still absorbing energy downward. That is, while flexure point 124 may still deflect downward, the surfaces deflecting open adjacent angles during the impact, while flexure point 123 results in a downward deflection and a closing of the angle between, for example, surface 116 and panel 112. The flexure points may engage one another through a friction interface, such that the bending flexure of the respective components is controlled through a predetermined distance of travel (e.g., the difference between distance X1 shown in FIG. 3 and X2 shown in FIG. 4). The controlled absorption of impact is effected due to the offset load absorption as shown and the forced friction interaction between the two opposing pivot points (e.g. at the friction interface between the panels). Although the transition shown between product support surface 122 and adhesion region 120 is shown generally as a rounded step, in some embodiments the transition between product support surface 122 adhesion region 120 may form a more gradual transition, such as a spline. The same is true for the transition between product support surface 122 and flexure region 124.

Cushioning element 100 is hollow top and bottom panels 200 and 300 include open space between the friction inter face between them and the points where they are attached to one another. This reduces the ultimate weight of cushioning element 100, and allows the freedom of movement between top and bottom panels. Additionally, this configuration hides and protects friction interface 126 during use.

As shown, top and bottom panels 200 and 300 of cushioning element 100 may be contoured such that a single panel may bend or contour to provide a product support surface, sidewalls, flanges, etc., similar to a deep drawn sheet metal or thermoplastic part. In some embodiments, the top and bottom panel of the cushioning element may be a continuous sheet that is bent or formed back onto itself to provide for the upper and lower components/panels. As described, the bending or flexure of the top component 200 and bottom component 300 during an impact may further cause a sidewall 128 of the cushioning element 100 to flex or bow inward, thereby effectively squeezing a product or finished good box therein. The respective components may be formed of the same material or different materials (e.g., different cellulose-based material). For example, the top surface may be made from molded fiber, and the bottom surface may be made from greyboard. The cushioning element may be configured as an end cap.

The packaging components may be composed of a recyclable material (e.g., a biodegradable or compostable material). If and when the customer opts to dispose of the packaging, because the entire packaging is recyclable and cellulose-based, the packaging may simply be recycled without requiring material separation (e.g., in a single-stream recycling program). Advantageously, this improves upon prior systems having, for example, expanded polystyrene, foams, or plastic film retention systems, which provide cushioning or impact protection but not afford an environmentally friendly solution. By designing the opposing pivot points and frictional interface between the corresponding features of the molded fiber cushioning element 100, an environmentally friendly solution is provided it still results in secure packaging, resilient impact protection, and aesthetically pleasing packaging components.

Packaging 10, including cushioning element 100, is constructed to give a clean, unitary appearance. This helps to reinforce its high quality and robust character, and that of the product. To achieve this appearance, seams, gaps, and raw material edges are minimized (raw material edges are edges formed by cutting through a flat material, where the substance of the material between its outer flat surfaces is revealed). Packaging 10 may be a particular color, e.g., a brand-identifier color. In some embodiments, visible surfaces of packaging 10 may be predominantly white. In some embodiments, components of the packaging may be folded from one or more sheets, such that when folded over and adhered together there is no raw edge on the outside of the component or packaging 10. In some embodiments, components of packaging 10 may be constructed with multiple blanks.

Components of packaging 10, such as cushioning element 100, may be formed from one or more blanks, or molded fiber components. In some embodiments, the blank is formed of a single continuous substrate, such as, for example cellulose-based material like cardboard or paperboard. In some embodiments, lower cost and robust material such as corrugated cardboard or greyboard is used for a portion of cushioning element 100, which may be formed from one or more blanks, for example in non-customer facing surfaces. In some embodiments, interior surfaces of the cushioning element 100 may be surface treated or coated, for example with a coating to protect the finished good box 400, or product. Tabs, flaps, and regions without adhesive of the blank are folded such that no adhesive is visible in finished packaging 10. In some embodiments, adhesive may be omitted and the various flaps and tabs attached in another suitable manner (e.g., by mechanical interlock or press fit). Fold lines may be formed, for example, by weakening the substrate along the lines, such as by perforation, material crushing, scoring, miter cutting, etc.

In some embodiments cushioning element 100 may be formed from one or more molded fiber components, and each molded fiber component may include particular die cut features specifying dimensions for critical points in a given application, such as the forced friction interface, the flexure pointer region, and various cutouts to accommodate additional packaging components, or goods, such as products.

Figure 5:
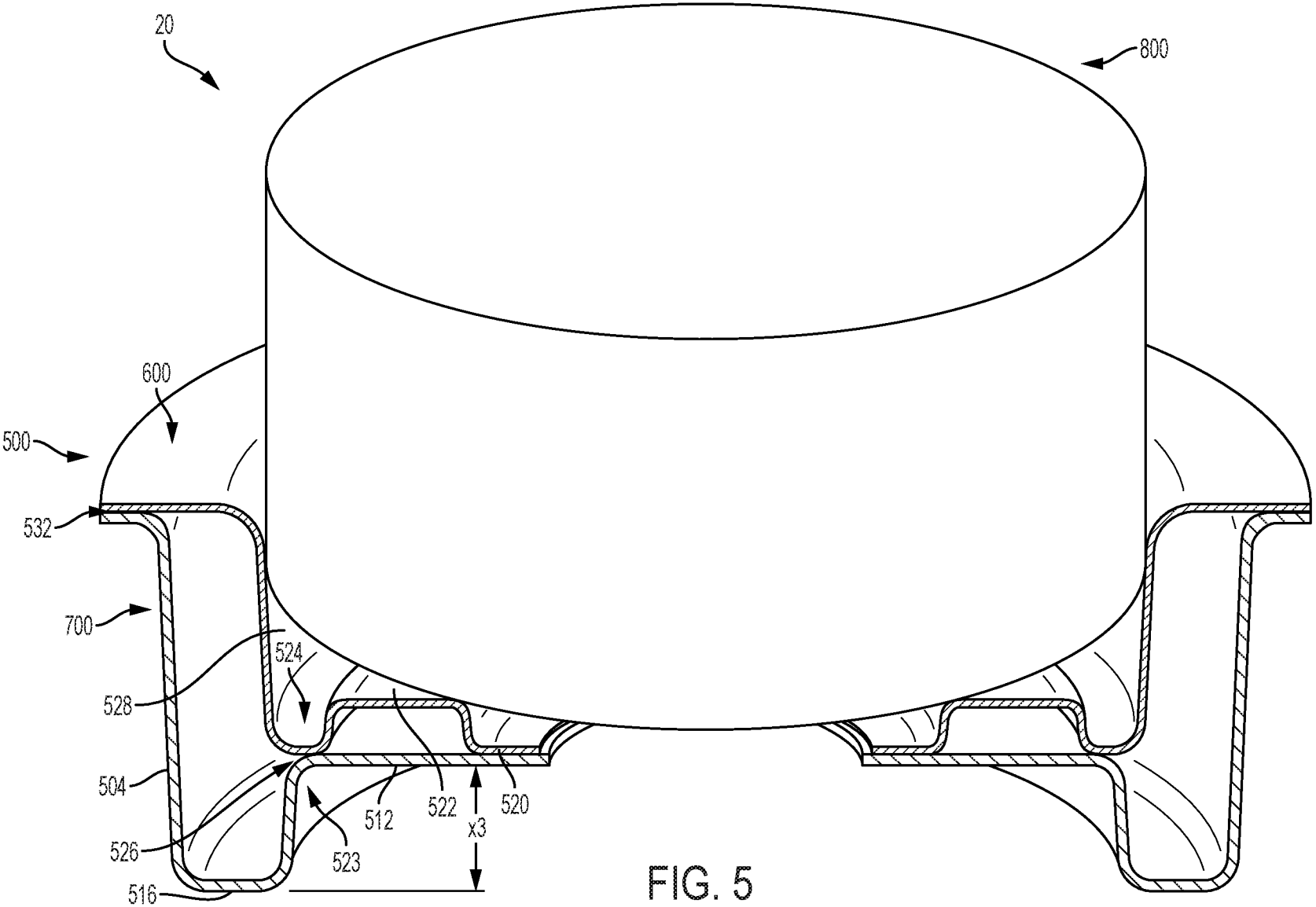
FIG. 5 shows a top isometric view of a packaging component in an embodiment and shows a product held by the packaging.
Figure 6:
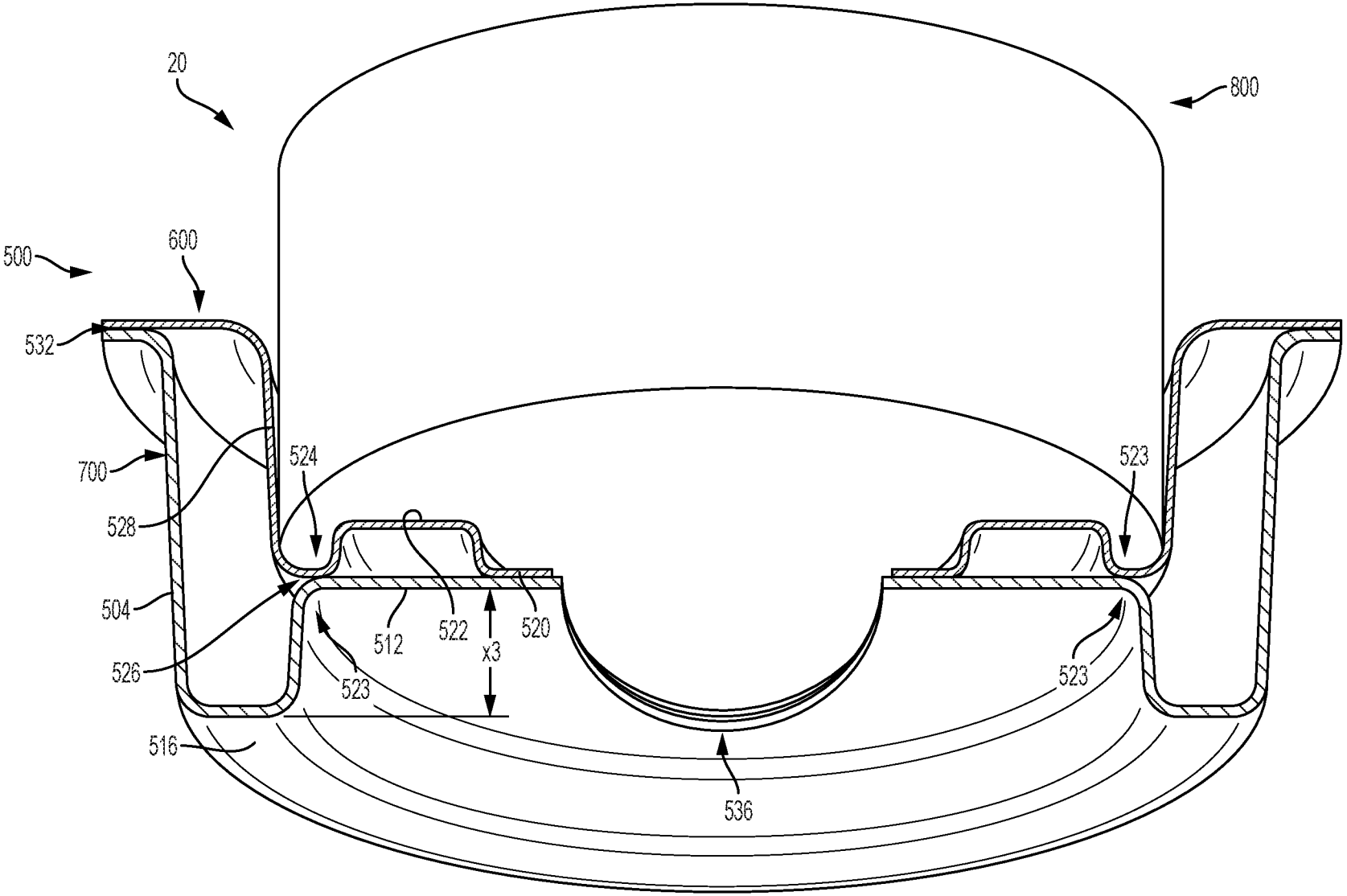
FIG. 6 shows a bottom isometric view of the packaging component and product shown in FIG. 5.
Figure 7:
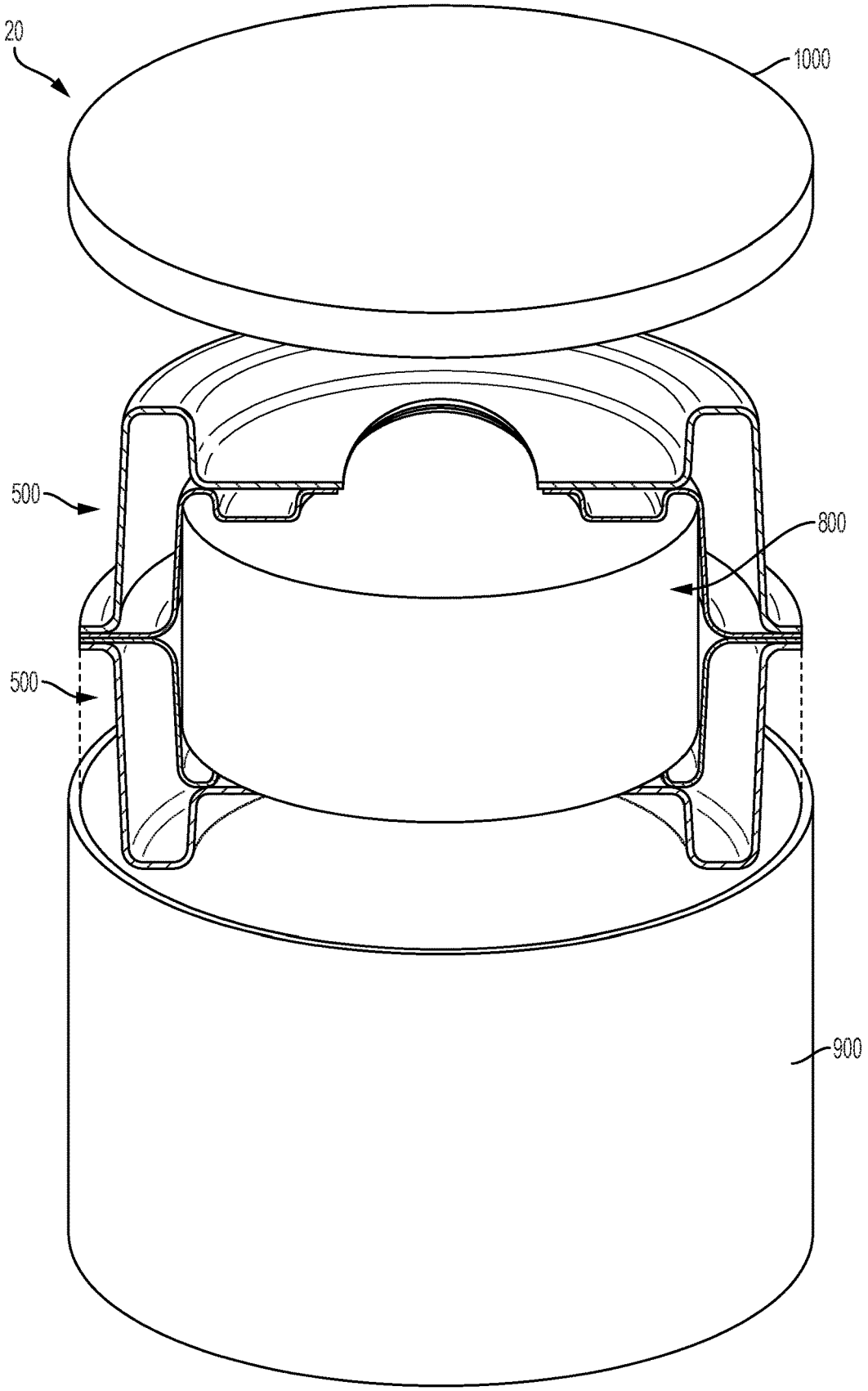
FIG. 7 shows two packaging components and product shown in FIGS. 5 and 6, with a box and lid in an embodiment.

Turning to FIGS. 5 and 6, packaging 20 is shown that holds product 800. Similar to packaging 10, packaging 20 includes cushioning element 500. Instead of a rectangular cuboid shape as in cushioning element 100 described above, cushioning element 500 may have a different shape, such as a section of a cylindrical circular volumetric form. In this way, a general cushioning element may be adapted to a particular products dimensions and shape for a particular application in particular impact absorption characteristics. As shown, cushioning element 500 may include upper molded fiber component 600 and lower molded fiber component 700, also configured as panels. Cushioning element 500 may include inner wall 528 that conforms to an exterior surface product 800. As shown, a product support surface 522 may be provided, and during an impact or other downward force, distance X3 may also decrease through deflection of product support surface 522 through flex regions 523 and 524, respectively. This is due to the opposing pivot points that interact through frictional interface 526, similar to those described above with reference to FIGS. 1-4. Outer wall 504 and inner wall 528 may towards product 800 during an impact similar as to the corresponding elements in cushioning element 100 described above. Upper and lower components 600 and 700, respectively, may fixed together at or about their peripheries via adhesion regions 532 and 520 similar to the embodiments described above with reference to corresponding elements in cushioning element 100. As shown in FIG. 6, gaps 536 may isolate the product support surfaces 522 from one another such that they are independently flexible. In some embodiments, as shown in FIGS. 5-7, the shape of gap 536 may be shaped such that it generally follows the shape of the cushion element. In some embodiments, a gap 536 may be symmetrical to allow for even flexing across a particular product support surface 522. Gap 536 instead may be asymmetrical, and allow for independent and controlled flexing of product support surface 522 such that different product support surfaces may flex unevenly by design. For example, if gap 536 were formed as a straight line cutout, the shape of the respective product support surface 522 on either side of the gap may flex unevenly along its plane.

Cushioning element 500 may include corresponding features described with reference to cushioning element 100 without limitation.

FIG. 7 shows an exploded assembly view showing cross sections of cushioning elements 500 positioned above and below product 800. During shipment, product may be received between the top and bottom cushioning elements 500 to retain and protect product 800 against impact and vibrations, with the cushioning elements 500 serving as endcaps. As shown, the finished packaging may also include, for example, a base box 900 to receive product 800 to receive product 800 (within the cushioning elements 500) during shipment. Lid 1000 may be provided to close base box 900. In some embodiments, an array of products 800 (within cushioning elements 500) may be disposed next to one another within base box 900, and may be stacked on top of one another for shipment. A finished package may additionally include a tray, support structures, etc.

In some embodiments, any surface finishing may take place after the components are cut from the blank, or alternatively prior to the blank being cut into separate sheets for assembling to a final product. Additionally, some operations may be performed concurrently. All or some of the surfaces of the packaging may be coated, or laminated, which may increase structural strength properties such as rigidity and which may protect a product within the packaging, or avoid scratching.

Additionally, the packaging may be manufactured in a cost-effective and environmentally-friendly way. In some embodiments, the packaging components may be constructed of a single integrally-formed piece of material. The single integrally-formed piece of material may be a foldable material that is folded into a configuration that holds and secures a product, either alone or within a cavity of a packaging container. In some embodiments, the foldable material may be a single piece of material that is cut by a single operation (e.g., a single die-cutting operation). In some embodiments, the foldable material may be die cut from a stock material e.g., a sheet or roll of material), or molded fiber. Single integrally-formed pieces of material that are cut by a single cutting operation may facilitate efficient and reproducible manufacturing. Moreover, such manufacturing may reduce waste by reducing waste material during manufacturing.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings.

What is claimed is:

1. Packaging, comprising:

a first molded fiber cushion component comprising:

a first molded fiber component comprising a first panel having a product support surface that is flexible about a first flexure point;

a second molded fiber component comprising a second panel coupled to the first molded fiber component at a peripheral region and flexible at a second flexure point in an opposing direction from the first flexure point, wherein the second panel is coupled to the first panel at an outer periphery of the first molded fiber component and an inner periphery of the first molded fiber component; and a second molded fiber cushion component comprising:

a third molded fiber component having a product support surface that is flexible about a third flexure point;

a fourth molded fiber component coupled to the third molded fiber component at a peripheral region and flexible at a fourth flexure point in an opposing direction from the third flexure point, wherein the first molded fiber cushion component at least partially encloses an upper portion of a product, and wherein the second molded fiber cushion component at least partially encloses a lower portion of the same product, such that the molded fiber cushion components form end caps for the product.

2. The packaging of claim 1 wherein the product is a finished goods package.

3. The packaging of claim 1, further comprising:

a friction interface between the first and second flexure points, and a friction interface between the third and fourth flexure points, each configured such that the respective flexure points translate along respective surfaces of the molded fiber components in response to a force applied to the product support surface.

4. The packaging of claim 1, wherein each product support surface flexes about its respective flexure point to absorb an impact in response to a force applied downward to the product support surfaces.

5. The packaging of claim 1, wherein the first panel is contoured such that an interior periphery is formed to receive a product therein, the interior periphery transitioning into the product support surface and allowing the product support surface to flex relative to a wall formed from the first panel, wherein in response to a force applied to the product support surface of the first molded fiber component, the interior wall flexes towards the product.

6. The packaging of claim 5, wherein the second panel is fixed to the first panel at an outer periphery of the first molded fiber component and an inner periphery of the first molded fiber component.

7. The packaging of claim 5, wherein a portion of the second panel is free to translate along a distance along the first panel at a friction interface between the first and second flexure points.

8. The packaging of claim 1, wherein the first and second molded fiber cushions are received in a base box and the base box is closed by a lid.

9. The packaging of claim 1, wherein a plurality of first and second molded fiber cushions partially enclose a plurality of products, respectively, and wherein the plurality of first and second molded fiber cushions are positioned in a box for shipping.

10. A molded fiber cushion component comprising:

a first molded fiber component having a product support surface that is flexible about a first flexure point;

a second molded fiber component coupled to the first molded fiber component at a peripheral region and flexible at a second flexure point in an opposing mechanical direction from the first flexure point; and a friction interface between the first and second flexure points configured such that the first and second flexure points translate along respective surfaces of the first and second molded fiber components in response to a force applied downward to the product support surface.

11. The molded fiber cushion component of claim 10, wherein the first molded fiber component further comprises:

a second product support surface that is flexible about a third flexure point in the same direction as the first flexure point.

12. The molded fiber cushion component of claim 10, wherein the product support surface flexes about the first flexure point to absorb an impact in response to a force applied downward to the product support surface.

13. The molded fiber cushion component of claim 10, wherein the first molded fiber component comprises a first panel forming a wall contoured such that an interior periphery is formed to receive a product therein, the interior periphery transitioning into the product support surface and allowing the product support surface to flex relative to the wall.

14. The molded fiber cushion component of claim 13, wherein the second molded fiber component comprises a second panel fixed to the first panel at an outer periphery of the first molded fiber component and an inner periphery of the first molded fiber component.

15. The molded fiber cushion component of claim 13, wherein a portion of the second panel is free to translate along a distance along the first panel at the friction interface between the first and second flexure points.

16. A molded fiber cushion component comprising:

a first molded fiber panel having first and second product support surfaces that are downwardly flexible;

a second molded fiber panel coupled to the first molded fiber panel at a peripheral region and downwardly flexible at friction interfaces between the first and second molded fiber panels proximate the first and second product support surfaces, wherein the first and second product support surfaces are substantially coplanar in a first configuration, wherein the friction interfaces are positioned between the first and second molded fiber panels at areas of contact between flexure points of the first and second molded fiber panels, the friction interfaces being configured to allow translation of the first and second molded fiber panels against each other in response to a force applied downward to a product support surface, and such that a downward force on a product support surface is offset between the flexure points of the first and second molded fiber panels, respectively.

17. The molded fiber cushion component of claim 16, wherein the first and second product support surfaces are independently downwardly flexible.

18. The molded fiber cushion component of claim 16, wherein the first and second product support surfaces extend inward from opposing sidewalls of the molded fiber cushion component.

19. The molded fiber cushion component of claim 16, further comprising:

sidewalls forming a cavity to receive a product therein, wherein the first molded fiber panel further comprises third and fourth product support surfaces that are downwardly flexible and are substantially coplanar in the first configuration, and wherein each of the product support surfaces extend inward from the sidewalls and are independently downwardly flexible.

20. A packaging system comprising the molded fiber cushion component of claim 16, wherein a plurality of first and second molded fiber cushion components partially enclose a plurality of products, respectively, and wherein the plurality of first and second molded fiber cushion components are positioned in a box for shipping.

* * * * *